United States Patent [19]

Fitzsimons

[11] 4,135,712

[45] Jan. 23, 1979

[54] ROCKING TOY

[76] Inventor: Ron Fitzsimons, 5557 Fleming St., Vancouver, British Columbia, Canada

[21] Appl. No.: 806,051

[22] Filed: Jun. 22, 1977

Related U.S. Application Data

[63] Continuation-in-part of Ser. No. 663,855, Mar. 4, 1976, abandoned.

[51] Int. Cl.[2] ..... A63G 11/00

[52] U.S. Cl. ..... 272/56

[58] Field of Search ..... 272/56, 55, 54, 30, 272/87, 52, 52.5, 53.1, 53.2, 109, 110, 111, 112, 113, 65, 33 R, 49; 297/247; 258, 259, 260, 261, 262, 263, 264, 265, 266, 267, 268, 269, 270, 271, 272, 183; D34/5 B, 5 C, 5 D; 280/2.193

[56] References Cited

U.S. PATENT DOCUMENTS

| | | | |
|---|---|---|---|
| D. 58,130 | 6/1921 | Bodenmiller | D34/5 D |
| D. 169,049 | 3/1953 | Walton | D34/5 D |
| 121,094 | 11/1871 | Fowler | 272/56 |
| 255,030 | 3/1882 | Russell | 272/56 |
| 889,562 | 6/1908 | Wagner | 272/54 |
| 1,270,219 | 6/1918 | Schwarz | 272/56 |
| 1,312,382 | 8/1919 | Benas | 272/56 |
| 1,349,701 | 8/1920 | Wallace | 292/56 |
| 1,434,850 | 11/1922 | Smith | 272/30 |
| 1,493,882 | 5/1924 | King | 272/56 |
| 1,552,841 | 9/1925 | Hector | 272/30 |
| 1,754,109 | 4/1930 | Kitze | 272/56 |
| 2,184,097 | 12/1939 | Grampp | 272/30 UX |
| 3,010,719 | 11/1961 | Johnson | 272/56 |
| 3,212,790 | 10/1965 | Burling | 272/33 X |

FOREIGN PATENT DOCUMENTS

| | | | |
|---|---|---|---|
| 131103 | 1/1949 | Australia | 272/56 |
| 228026 | 4/1960 | Australia | 272/56 |
| 387700 | 10/1933 | United Kingdom | 272/49 |

*Primary Examiner*—Richard C. Pinkham
*Assistant Examiner*—Arnold W. Kramer
*Attorney, Agent, or Firm*—Robert D. Farkas

[57] ABSTRACT

A rocking toy that embodies the features of a seesaw and a rocker and is adapted to hold the child and at the same time is portable such that it may be used indoors. Foot supports are provided as are back rests and handles, with at least one of the handles being adjustably positionable with respect to its distance from its backrest. Adjustable springs on the ends of the device limit the rocking.

5 Claims, 5 Drawing Figures

Fig. 1
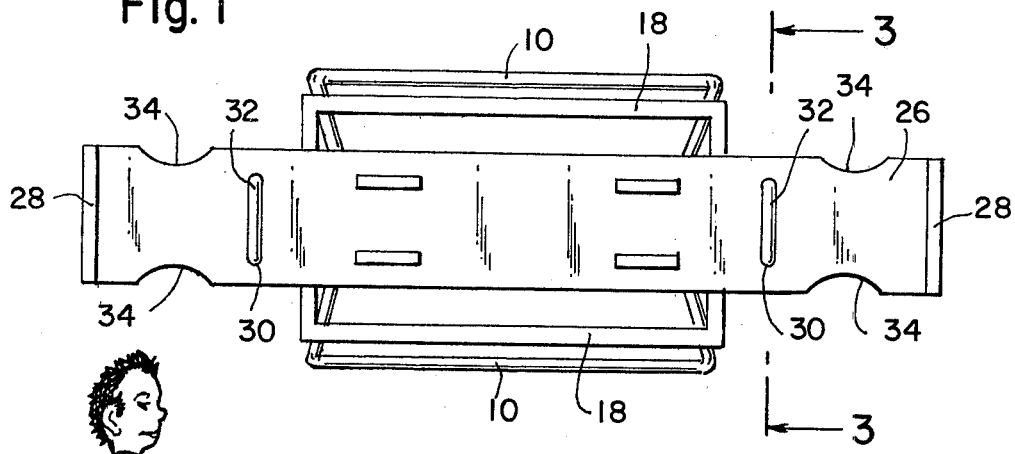
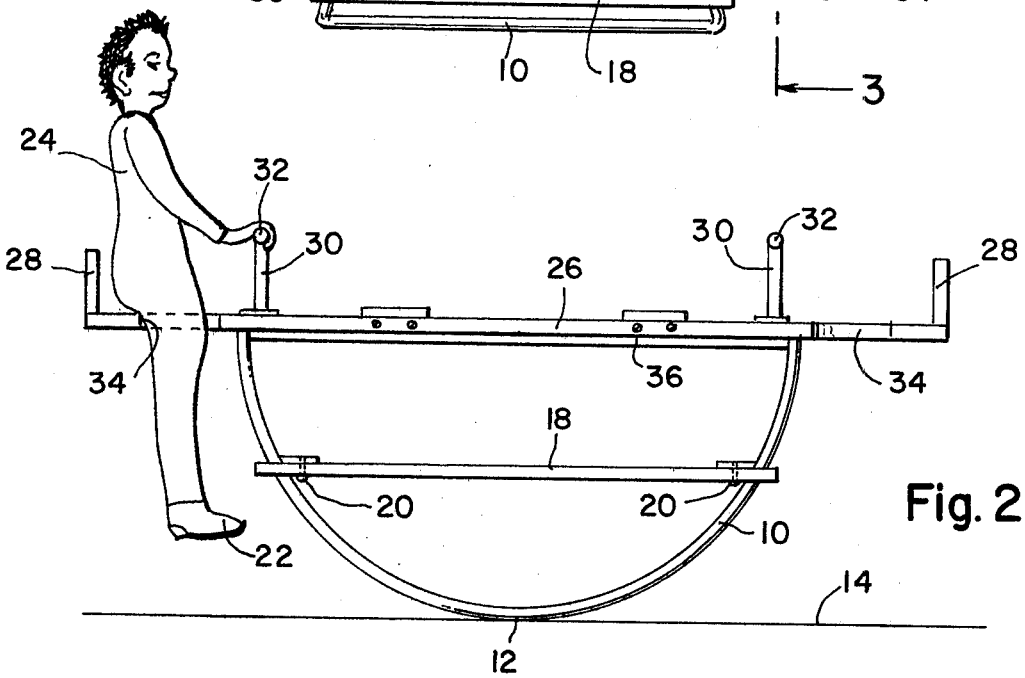
Fig. 2
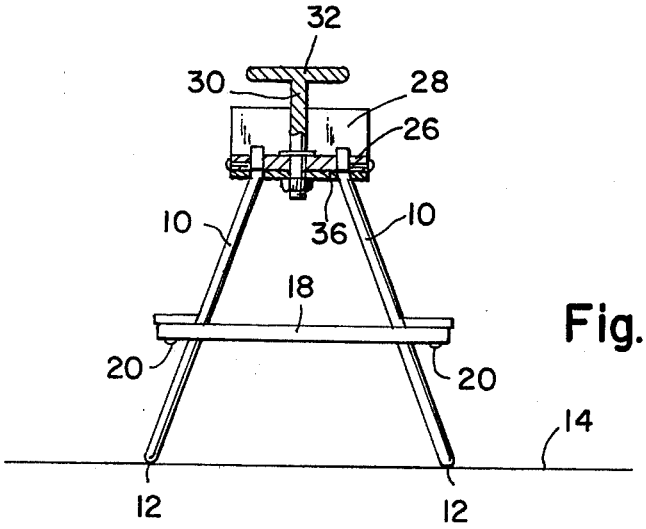
Fig. 3

ROCKING TOY

This is a continuation-in-part application of Ser. No. 663,855, filed Mar. 4, 1976, and now abandoned.

BACKGROUND OF THE INVENTION

This invention relates to a rocking, seesaw type apparatus for children. More particularly to a portable apparatus that may be enjoyed in the confines of the home as well as outdoors. The prior art teaches a variety of childrens exercise and fun devices of the general character known as seesaws and the like, for example as disclosed in U.S. Pat. Nos. 420,716; 501,005; 818,079; 1,006,666; 1,434,850; 1,652,993; 2,533,005; 3,614,096; and others. None of the foregoing, however, provides for a combined rocking and seesaw operation as is instantly claimed.

SUMMARY OF THE INVENTION

It is accordingly an object of the instant invention to provide for an improved exercise and enjoyment device of the type aforedescribed.

It is another object to provide for the same at relatively little cost thereby making it generally available.

These and other objects and advantages of the invention will become more apparent from the following detailed disclosure and claims and by reference to the accompanying drawings, in which:

FIG. 1 is a top plan view;

FIG. 2 is a side elevational view; and

FIG. 3 is a sectional view taken along the line 3—3 of FIG. 1.

Figure 4:
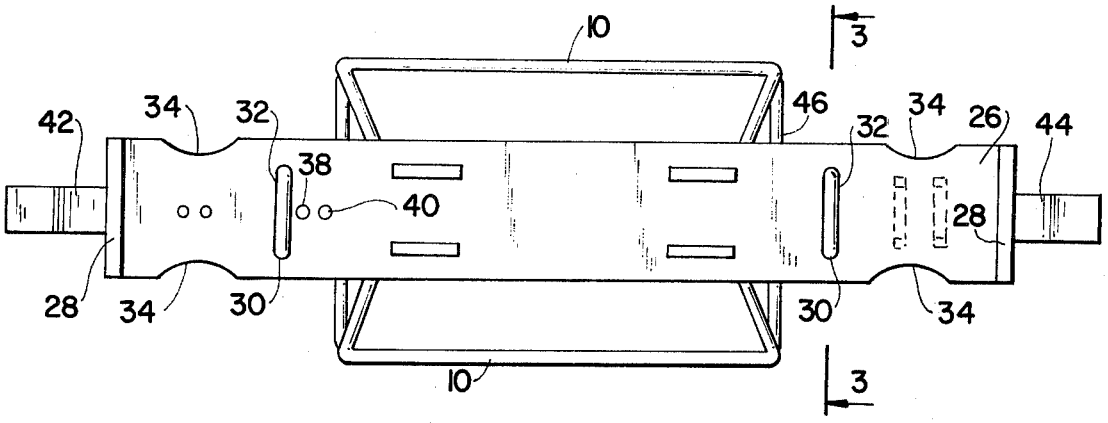
FIG. 4 is a top plan view of an alternate embodiment.

Broadly speaking, the instant invention includes the provision of a combination seesaw and rocking device compising a pair of coaxially aligned substantially hemiarcular shaped base support members adapted to move in tandem in cam fashion relative to a horizontal support surface, a pair of horizontally disposed support members transverse the base and forming an arc thereacross, a suspension member disposed across the open end of the base members and in contact therewith, a pair of first upright support members disposed at the distal ends of the suspension member and adapted to function as a back support for a rider seated thereon, a pair of second upright members each having a horizontal gripping portion disposed forward of the first support members and adapted to serve or handle means for the rider.

An alternate embodiment of the present invention includes a pair of spring-like members, each being disposed secured to the underside of the suspension member, depending downwardly therefrom and shaped arcuately so as to have the free ends thereof engage the surface of the ground and provide an upward force when the support member is directed downwardly to the ground thereby causing the rocker to easily and conveniently spring back and continue in oscillations. The pair of second upright members are modified such that the first of the pair of members is fixedly secured to the suspension member and the other of the pair of second upright members being disposed removably in any of three holes located in the suspension member. This permits the other of the second upright members to be adjusted selectively along the length of the suspension member so as to enable the entire apparatus to be adjusted to accommodate for variations in the weight of a pair of users. The alternate embodiment also includes a pair of horizontally disposed support members installed transverse the hemi-circular shape base support members, such additional pair of horizontally disposed support members being installed approximately midway between the point of contact of the hemi-arcular shape base support members where contacting the ground, and the location of the suspension member.

DETAILED DISCLOSURE

Referring more particularly to the drawings as shown in FIGS. 1, 2 and 3, there is shown a pair of substantially U-shaped support members 10 that are each preferably hemicircular in shape, the rounded portion forming the point of contact 12 with the floor or other suitable base support 14. The member 10 is adapted to rock forward are backward along the outer surface of the member 10 as the same contacts the floor 14. The two members 10 are in coaxial alignment with each other.

Each member 10 will have a transverse rod or shaft member 18 disposed across the same at about 1/3–1/2 of the way upward from the point of contact 12; the foregoing adapted to serve as a safety bar or the like in order to give stability to the apparatus. The shaft member 18 is preferably permanently affixed by its distal end portions to the opposite sides of the member 10, such as by welding, rivets, etc. or any other suitable fastening or affixation means 20. The member 18 also may function as a point of contact for the feet 22 of the rider 24 if desired. In this instance, it may be desirable to have the member 18 be longer than the transverse direction across the arc of the member 10, thereby extending therebeyond for greater comfort, as is shown in FIG. 3.

Disposed substantially across the top section of the member 10, forming the transverse or top closed section of the hemicircular shape will be a substantially planar suspension bar or beam 26. The beam 26 will include two upwardly extending members at each end thereof. A distally located upright member 28 that forms a backsupport for the rider 24 and forward thereof, at about the point of contact with the member 10 a second upright member 30 that has a horizontal cross bar 32 thereon for handle means. If desired, the beam 26 may define a pair of opposing notched areas 34 disposed between each pair of uprights 28, 30, for accommodation of the thighs of the rider 24.

Additional stability can be imparted to the device by having a second beam 36 disposed beneath the first beam 26, in contact therewith, in planar alignment, but extending only edge to edge across the member 10, whereas, the first beam 26, extends beyond the member 10 across both end sections.

The entire assembly may be constructed of any suitably rigid material such as high impact plastic, metal, wood, etc.

FIG. 4 illustrates an alternate embodiment, to the apparatus as shown in FIG. 1 illustrating an additional pair of holes 38 and 40, facilitating horizontal bar 32 being permitted to be moved inwardly at two locations towards the center of support member 26. This is accomplished by permitting upright member 30, as shown in FIG. 2, to be installed into holes 38 and 40, selectively. The other horizontal cross bar 32, as shown in FIG. 4 is locked in its location, because the equivalent of holes 38 and 40 are not provided on that side of support member 26.

Spring members 42 and 44 are shown secured underneath support member 26, and as illustrated, extend outwardly therefrom so as to engage the surface of the ground, not shown, as support member 26 is pivoted above the plane of the ground. FIG. 4 also illustrates transverse members 46, extending parallel to an under surface of support member 26 and engaging the downwardly directed portions of U-shaped support members 10. Members 46 are shown removably affixed to member 10, thus lowering the cost of manufacturing and the weight of the entire apparatus.

Figure 5:
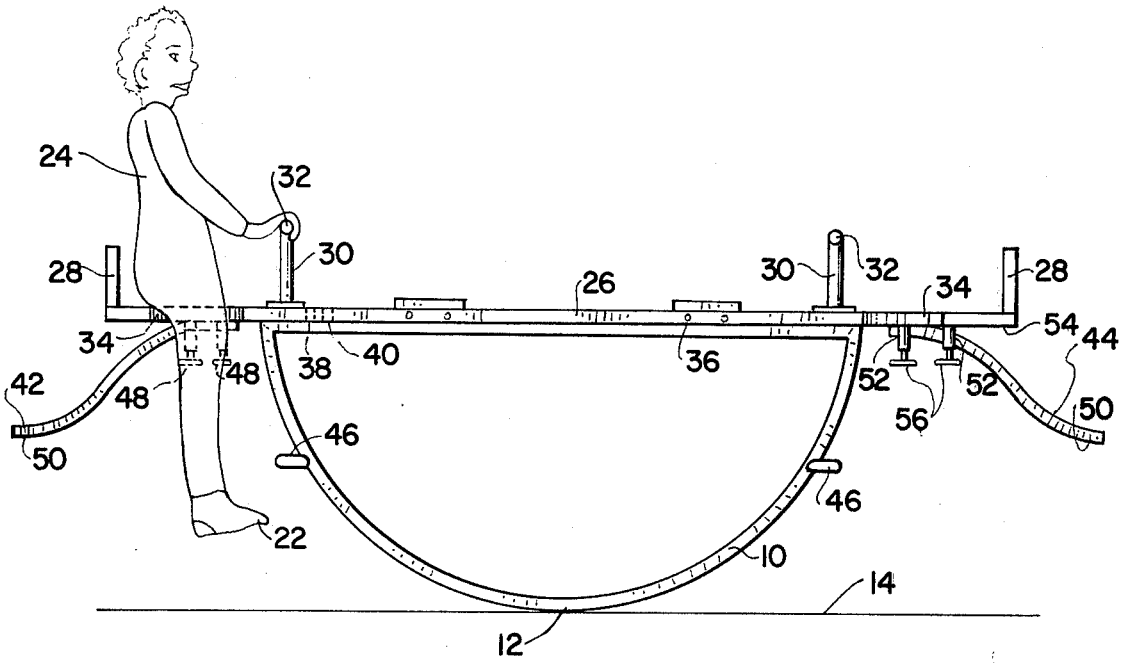
FIG. 5 is a side elevational view of the alternate embodiment.

FIG. 5 illustrates user 24 shown supported by support member 26. Spring members 42 and 44 are shown installed affixed to the undermost lateral surface of support member 26. They may be secured to support member 26 by a pair of bolt members 48, shown passing through openings in support member 26 and corresponding openings in spring member 42 at one end thereof. Portion 50, of spring members 42 and 44 are adapted to engage the surface of the ground. Alternatively, U-shaped members 52 may be employed to secure spring members 42 and 44 to the under surface of support member 26. As illustrated U-shaped members 52 are utilized to provide locking and clamping support to spring member 44. U-shaped devices 52 are fixedly secured to the under surface 54 of support member 26, and are provided with wing bolts 56 which engage spring member 44 at preferred locations so as to clamp spring member 44 against under surface 54. Thus, spring member 44 may be clamped at any preferred location so as to extend a variable distance outwardly from support member 28, located at the right hand end of support member 26.

FIG. 5 also illustrates transverse members 46 shown clamped to arcuately shaped base members 10 and extending substantially midway between point 12 and undermost surface 54. It is to be noted that the foot 22 of user 24 may be disposed in touching engagement with transverse members 46 so as to provide support for the foot of the user whenever desired.

Since it is obvious that numerous changes and modifications can be made in the above-described details without departing from the spirit and nature of the invention, it is to be understood that all such changes and modifications are included within the scope of the invention.

I claim:

1. A combination seesaw and rocking device comprising a pair of coaxially aligned substantially hemi-circular shaped base support members adapted to move in tandem in cam fashion relative to a horizontal support surface, a pair of horizontally disposed flat support members transverse said base members and extending thereinbetween, a solid flat suspension member disposed across the midpoint of the open end of said base members and in contact therewith, a pair of first flat upright support members disposed at the distal ends of said suspension member, each of said pair of first flat upright supporting members having a flat lateral surface, said lateral surface extending normal to said suspension member, said lateral surface of each of said first upright support members in opposed relationship to each other and having a marginal edge thereof engaged with an upper surface of said suspension member, said pair of first support members adapted to function as a back support for a rider seated thereon, a pair of second flat upright members each having a horizontal gripping portion disposed forward of said first support members and adapted to serve as handle means for said rider, one of said pair of said second flat upright members being disposed fixedly secured to said suspension member, the other of said pair of second flat upright members being disposed selectively at at least two locations forward of one of said first support members, said suspension member defining a pair of opposed notched areas between each of said first and second upright members that is adapted to receive the thighs of said rider, said suspension member extending beyond the arc of said hemicircle, a pair of spring members, said pair of spring members being fabricated from a material having spring-like characteristics, one end of said pair of spring members being secured to said suspension member, the other end of said pair of spring members extending beyond said arc of said hemicircle, said other end of said spring members extending downwardly from said suspension member, means to adjustably secure said spring members to said suspension member such that said other ends of said spring members may be disposed at a variety of locations outwardly from said arc of said hemicircle.

2. The device as defined in claim 1 wherein said horizontally disposed support members extend beyond the arc of said hemicircle thereby adapted to receive the feet of said rider.

3. The device as claimed in claim 1 further comprising a a second suspension member, said second suspension member disposed beneath said first suspension member and in contact therewith, said second suspension member having a length approximately the same as the diameter of said hemicircle.

4. The device as claimed in claim 1 further comprising said suspension member having at least a pair of openings therein, said at least a pair of openings being disposed forward of one of said first support members, said at least a pair of openings for fastening said other of said pair of second flat upright members at selected locations along the length of said suspension member.

5. The device as claimed in claim 1 wherein said spring members are fabricated from spring steel.

* * * * *